US010529476B2

(12) United States Patent
Park et al.

(10) Patent No.: US 10,529,476 B2
(45) Date of Patent: Jan. 7, 2020

(54) COIL COMPONENT AND METHOD FOR MANUFACTURING THE SAME

(71) Applicant: SAMSUNG ELECTRO-MECHANICS CO., LTD., Suwon-si, Gyeonggi-do (KR)

(72) Inventors: Ho Sik Park, Suwon-si (KR); Sang Jae Lee, Suwon-si (KR); Youn Soo Seo, Suwon-si (KR); Yong Sam Lee, Suwon-si (KR); Hye Yeon Cha, Suwon-si (KR); Jae Ha Kim, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 5 days.

(21) Appl. No.: 15/665,263

(22) Filed: Jul. 31, 2017

(65) Prior Publication Data

US 2018/0158584 A1 Jun. 7, 2018

(30) Foreign Application Priority Data

Dec. 2, 2016 (KR) ..... 10-2016-0163470

(51) Int. Cl.
*H01F 5/00* (2006.01)
*H01F 5/04* (2006.01)
*H01F 41/04* (2006.01)

(52) U.S. Cl.
CPC ..... *H01F 5/003* (2013.01); *H01F 5/04* (2013.01); *H01F 41/041* (2013.01)

(58) Field of Classification Search
CPC ..... H01F 41/041; H01F 17/0013
(Continued)

(56) References Cited

U.S. PATENT DOCUMENTS 6,459,351 B1 * 10/2002 Maki ..... H01F 27/2804 336/200
7,394,341 B2 * 7/2008 Shimoyama ..... H01F 17/0006 336/200
(Continued)

FOREIGN PATENT DOCUMENTS

CN 102969304 A 3/2013
CN 104934187 A 9/2015
(Continued)

OTHER PUBLICATIONS

Korean Office Action issued in corresponding Korean Patent Application No. 10-2016-0163470, dated Jan. 19, 2018, with English Translation.
(Continued)

*Primary Examiner* — Ronald Hinson
(74) *Attorney, Agent, or Firm* — Morgan, Lewis & Bockius LLP

(57) ABSTRACT

A coil component includes a body having a coil part disposed in the body. The coil part may include: a first coil pattern formed on one surface of the insulating layer; and a second coil pattern including an external pattern formed on the other surface of the insulating layer. The second coil pattern may further include an embedded pattern embedded in the insulating layer and the external pattern may be disposed on the embedded pattern. The coil component can have improved low direct current resistance characteristics and inductance.

12 Claims, 6 Drawing Sheets

(58) Field of Classification Search
USPC ..... 336/200
See application file for complete search history.

(56) References Cited

U.S. PATENT DOCUMENTS

| | | | | |
|---|---|---|---|---|
| 7,911,295 | B2 * | 3/2011 | Inuzuka | H01F 17/0013 333/185 |
| 9,945,042 | B2 | 4/2018 | Cha et al. | |
| 2010/0052839 | A1 * | 3/2010 | Mertens | H01L 23/48 336/232 |
| 2012/0133472 | A1 * | 5/2012 | Nishikawa | H01F 17/04 336/200 |
| 2013/0341758 | A1 | 12/2013 | Lee et al. | |
| 2014/0145812 | A1 | 5/2014 | Lee et al. | |
| 2014/0292469 | A1 | 10/2014 | Cha et al. | |
| 2015/0270053 | A1 * | 9/2015 | Cha | C25D 7/001 336/192 |
| 2016/0005527 | A1 * | 1/2016 | Park | H01F 41/042 336/200 |
| 2016/0336105 | A1 | 11/2016 | Choi et al. | |

FOREIGN PATENT DOCUMENTS

| | | | |
|---|---|---|---|
| CN | 105321676 | A | 2/2016 |
| CN | 106158242 | A | 11/2016 |
| JP | 2006-313946 | A | 11/2006 |
| KR | 10-1420525 | B1 | 7/2014 |
| KR | 10-2014-0117147 | A | 10/2014 |
| KR | 10-1580709 | B1 | 12/2015 |
| KR | 10-2016-0026940 | A | 3/2016 |

OTHER PUBLICATIONS

Office Action issued in corresponding Chinese Application No. 201710823231.6, dated Jul. 1, 2019.

* cited by examiner

COIL COMPONENT AND METHOD FOR MANUFACTURING THE SAME

CROSS-REFERENCE TO RELATED APPLICATION(S)

This application claims benefit of priority to Korean Patent Application No. 10-2016-0163470 filed on Dec. 2, 2016 in the Korean Intellectual Property Office, the disclosure of which is incorporated herein by reference in its entirety.

TECHNICAL FIELD

The present disclosure relates to a coil component and a method for manufacturing the same.

BACKGROUND

With the miniaturization and thinning of electronic devices such as digital TVs, mobile phones, and laptops, a coil component applied to such electronic devices has been required to be miniaturized and thinned. To meet such demand, research into and development of various winding type or thin film type coil components has been actively conducted.

The major issue in the miniaturization and thinning of coil components is to realize the same characteristics as existing coil components, despite the miniaturization and thinning thereof. In order to meet such demand, there is a need to increase a volume of a magnetic material and minimize a volume of an insulating material to secure low direct current resistance (Rdc).

SUMMARY

An aspect of the present disclosure may provide a coil component having a reduced volume of an insulation material in a body to secure low direct current resistance (Rdc) characteristics and a volume of a magnetic material increased by an amount equal to the reduced volume of the insulating material to improve inductance (Ls) characteristics, and a method of manufacturing the same.

According to an aspect of the present disclosure, a coil component may include a body having a coil part disposed therein. The coil part may include: a first coil pattern disposed on one surface of the insulating layer and a second coil pattern including an external pattern disposed on the other surface of the insulating layer. The second coil pattern may further include an embedded pattern embedded in the insulating layer and the external pattern may be disposed on the embedded pattern.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Hereinafter, a coil component according to an exemplary embodiment in the present disclosure will be described in detail with reference to the accompanying drawings. Although the coil component will be described by way of example with reference to a structure of an inductor for the sake of convenience, the coil component of the present disclosure may also be applied to other various coil components.

Figure 1:
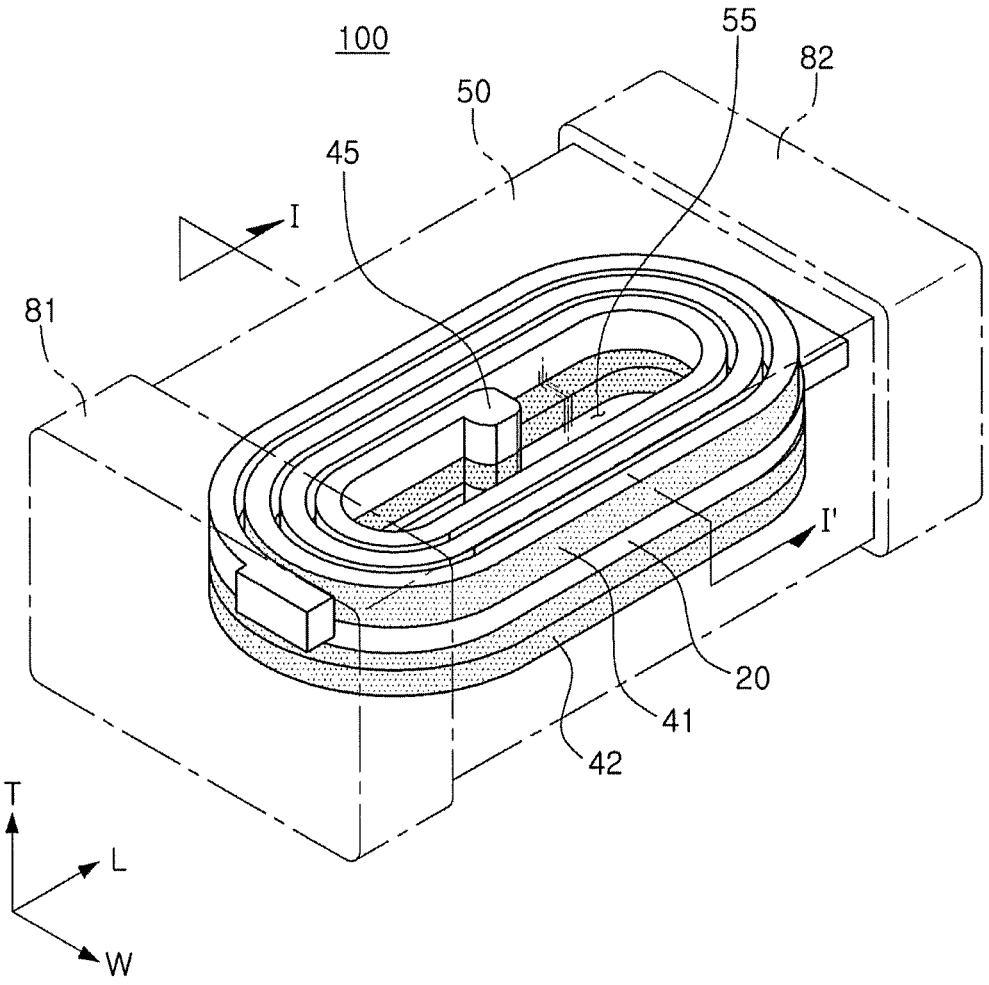
FIG. 1 is a schematic perspective view of a coil component according to an exemplary embodiment in the present disclosure.
Figure 2:
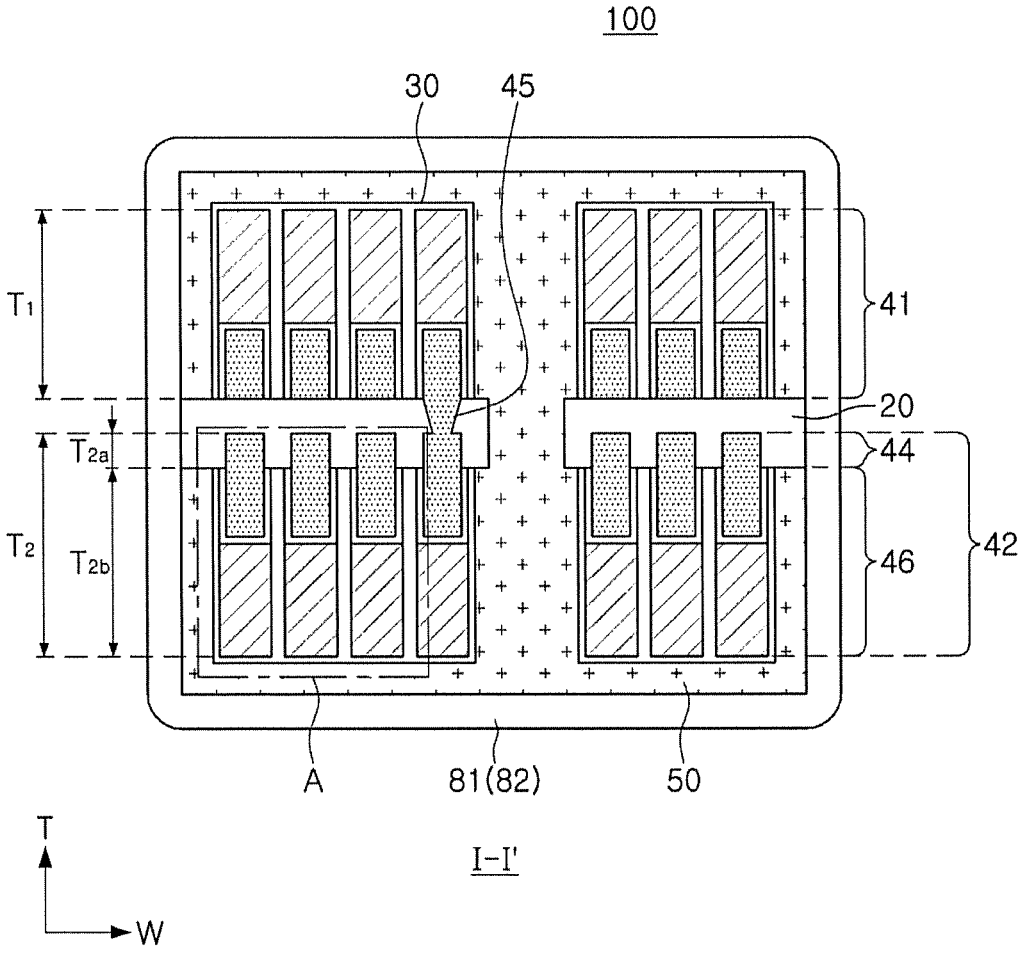
FIG. 2 is a diagram schematically illustrating a surface taken along line I-I' of FIG. 1 and is a schematic cross-sectional view of the coil component according to the exemplary embodiment in the present disclosure.
Figure 3:
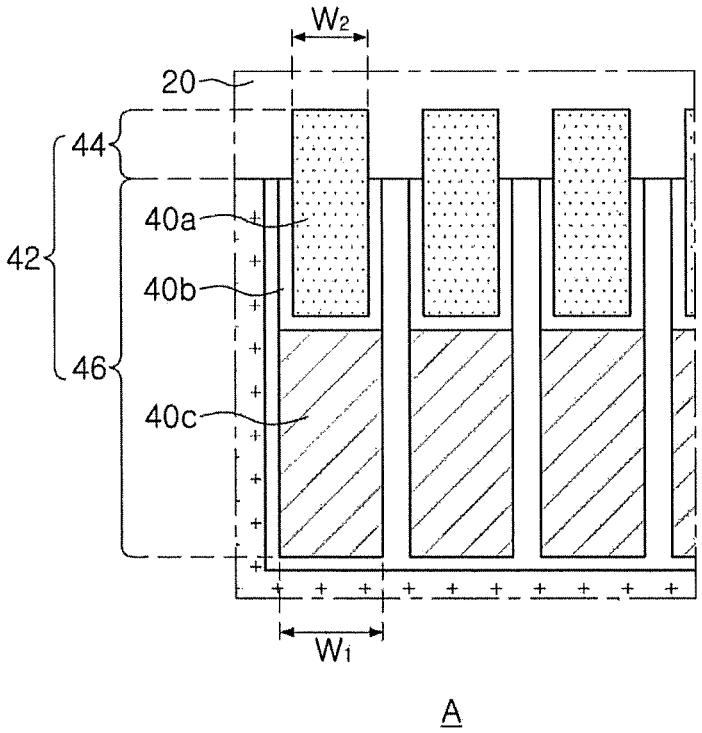
FIGS. 3 and 4 are enlarged views of part A of FIG. 2.

FIG. 1 is a schematic perspective view of a coil component according to an exemplary embodiment in the present disclosure, FIG. 2 is a diagram schematically illustrating a surface taken along line I-I' of FIG. 1 and is a schematic cross-sectional view of the coil component according to the exemplary embodiment in the present disclosure, and FIG. 3 is a schematic enlarged views of part A of FIG. 2.

FIGS. 1 through 3, a coil component 100 according to an exemplary embodiment in the present disclosure may include a body 50 having a coil part disposed therein, in which the coil part includes an insulating layer 20, a first coil pattern 41 formed on one surface of the insulating layer 20, a second coil pattern 42 formed on the other surface of the insulating layer 20 and including an embedded pattern 44 embedded in the insulating layer 20 and an external pattern 46 formed on the embedded pattern 44.

The body 50 may form an exterior of the coil component. L, W and T directions shown in FIG. 1 each indicate a length direction, a width direction, and a thickness direction. The body 50 may be a hexahedral shape including a first surface and a second surface facing each other in a stacking direction (thickness direction) of the first and second coil patterns 41 and 42, a third surface and a fourth surface facing each other in the length direction, and a fifth surface and a sixth surface facing each other in the width direction, but is not limited thereto. A corner where the first to sixth surfaces meet each other may be rounded by grinding or the like.

The body 50 includes a magnetic material that exhibits magnetic characteristics.

The magnetic material may be, for example, a resin including ferrite or magnetic metal particles.

The body 50 may be a form in which the ferrite or the magnetic metal particles are dispersed in the resin.

The ferrite may include Mn—Zn based ferrite, Ni—Zn based ferrite, Ni—Zn—Cu based ferrite, Mn—Mg based ferrite, Ba based ferrite, Li based ferrite, or the like.

The magnetic metal powder may include one or more selected from the group consisting of iron (Fe), silicon (Si), chromium (Cr), aluminum (Al), and nickel (Ni). For example, the magnetic metal powder may be a Fe—Si—B—Cr based amorphous metal, but is not limited thereto. A diameter of the magnetic metal particle may range from 0.1 μm to 30 μm.

The resin may be a thermosetting resin such as an epoxy resin and a polyimide resin.

The coil component 100 may play a role of performing various functions in electronic devices through the characteristics revealed from the coil of the coil component 100. For example, the coil component 100 may be a power inductor. In this case, the coil component 100 may serve to store electricity in a magnetic field form to maintain an output voltage, thereby stabilizing a power supply.

A method for forming coil patterns on both surfaces having a support member sandwiched therebetween and then forming a via on the support member by laser processing to electrically connect the coil patterns on both surfaces has been applied to the existing coil part. However, in the case of the above method, inductance may be lowered due to a thickness of the support member that is a nonmagnetic body, and there may be limitations in implementing a structure of the double-sided coil pattern by adjusting a thickness or width of the coil. Therefore, there may be limitations in implementation of the inductance and the low direct current resistance (Rdc) due to the miniaturization of the coil component.

In the coil component according to the exemplary embodiment in the present disclosure, the coil part may be provided with the plurality of coil patterns without the support member that is an insulating material. The present disclosure relates to the coil component capable of more reducing the thickness of the insulating material between the upper and lower coil patterns than before to secure the low direct current (Rdc) characteristics and increasing the volume of the magnetic material by the reduced volume of the insulating material to improve the inductance (Ls) characteristics and the method for manufacturing the same.

The coil part may include the insulating layer 20, the first coil pattern 41 formed on one side of the insulating layer 20, and the second coil pattern 42 formed on the other side of the insulating layer 20. The second coil pattern 42 may include the embedded pattern 44 embedded in the insulating layer 20 and the external pattern 46 formed on the embedded pattern 44.

The first coil pattern 41 may not include the embedded pattern inside the insulating layer 20 and may have an asymmetric structure to the second coil pattern 42 with respect to a central portion of the first and second coil patterns 41 and 42. The first coil pattern 41 may have a different thickness from the second coil pattern 42 including the embedded pattern.

The first and second coil patterns 41 and 42 may be formed by a photolithography process and a plating process.

The insulating layer 20 may serve to insulate the first coil pattern 41 from the second coil pattern 42.

The insulating layer 20 may be formed by laminating a precursor film including an insulating material on the support member and having the embedded pattern and then curing the precursor film. Thereafter, the first coil pattern and the external pattern may be formed on upper and bottom surfaces of the insulating layer removed from the support member.

The insulating layer 20 may be a build-up film containing an insulating material. As the insulating material, for example, a thermosetting resin such as an epoxy resin, a thermoplastic resin such as polyimide, or a resin such as a thermosetting resin and the thermoplastic resin in which a reinforcing material such as an inorganic filler is embedded to form an ajinomoto build-up film (ABF), or the like, may be used. Alternatively, it may be an insulating film including the known photoimageable dielectric (PID) resin.

The thickness of the insulating layer 20 may be larger than that of the embedded pattern 44 to cover the embedded pattern 44 and insulate the embedded pattern 44 from the first coil pattern 41.

The thickness from one surface of the insulating layer on which the first coil pattern 41 is disposed to the embedded pattern 44 may range from 5 μm to 30 μm.

In order to cover the embedded pattern 44 and to insulate the embedded pattern 44 from the first coil pattern 41, the overall thickness of the insulating layer may range from 15 μm to 130 μm, but is not limited thereto.

By reducing the thickness from the one surface of the insulating layer on which the first coil pattern 41 is disposed to the embedded pattern 44, the thickness of the insulating material 20 between the upper and lower coil patterns may be reduced and thus the inductance of the coil component may be improved.

The shape and material of a via 45 penetrating through the insulating layer 20 are not particularly limited as long as the via 45 may electrically connect between the first coil pattern 41 and the embedded pattern 44.

The via 45 may be formed by a method for filling a through hole formed by using at least one of a photolithography process, mechanical drilling, and laser drilling with a conductive material by plating.

The via 45 may have any shape known in the art, such as a tapered shape and a cylindrical shape as described above.

As the material of the via 45, conductive materials such as copper (Cu), aluminum (Al), silver (Ag), tin (Sn), gold (Au), nickel (Ni), lead (Pb), and alloys thereof may be used. The thickness of the insulating layer 20 may be usually smaller than that of the support member.

The second coil pattern 42 may include the embedded pattern 44 disposed inside the insulating layer 20 and formed to be exposed to the other surface of the insulating layer 20 and the external pattern 46 formed on the embedded pattern 44 exposed to the other surface of the insulating layer 20.

The embedded pattern 44 may be formed in the insulating layer 20 and may be in contact with the external pattern 46 formed on the other surface of the insulating layer 20. The embedded pattern 44 and the external pattern 46 may be in contact with each other so that boundaries between the embedded pattern and the external pattern may not be recognized with the naked eye.

The external pattern 46 may be a coil pattern extending from the embedded pattern. Therefore, the embedded pattern 44 and the external pattern 46 may have the same pattern shape.

The second coil pattern 42 may include the external pattern 46 formed together with the first coil pattern 41 after the embedded pattern 44 is formed. The external pattern 46 may formed on the other surface of the insulating layer 20 from which the embedded pattern 44 is exposed.

A thickness $T_2$ of the second coil pattern 42 is greater than a thickness $T_1$ of the first coil pattern 41.

Since the thickness $T_2$ of the second coil pattern 42 is greater than the thickness $T_1$ of the first coil pattern 41, the coil part may have an asymmetric structure due to the difference in thicknesses. This may be a structure in which the second coil pattern 42 includes including the embedded pattern 44 embedded in the insulating layer 20. By doing so, the electrical characteristics may be improved by the embedded pattern compared to the existing coil structure, the compactness and miniaturization may be easily implemented, and the design freedom of the inductor may be increased.

The distance from the uppermost of the first coil pattern to one surface of the body 50 that the first coil pattern faces may be equal to the distance from the lowermost of the second coil pattern to the other surface of the body 50 that the second coil pattern faces. That is, the second coil pattern 42 may have the increased thickness due to the embedded pattern 44 disposed in the insulating layer 20, and the insulating layer 20 may be located at a central portion in the thickness direction of the body 50.

The thickness $T_2$ of the second coil pattern 42 may be a sum of a thickness $T_{2a}$ of the embedded pattern 44 and a thickness $T_{2b}$ of the external pattern 46.

The thickness $T_{2b}$ of the external pattern 46 may be equal to the thickness $T_1$ of the first coil pattern 41.

The thickness $T_{2a}$ of the embedded pattern 44 may range from 10 μm to 100 μm and the thickness $T_1$ of the first coil pattern 41 and the thickness $T_{2b}$ of the external pattern 46 may range from 100 μm to 230 μm.

Referring to FIG. 3, a width $W_2$ of the embedded pattern may be smaller than a width $W_1$ of the external pattern.

After the embedded pattern 44 is formed, the external pattern 46 may be formed. At this point, the coil pattern may be prevented from misaligning due to eccentricity such as distortion, displacement, mark recognition, facility tolerance of the substrate and a short may occur due to the contact of the coil pattern with adjacent coil patterns.

If the width $W_2$ of the embedded pattern is large, the short may occur due to the eccentricity of the external pattern. In this case, it is possible to prevent the short due to the eccentricity by reducing the width of the external pattern, but the area of the entire coil pattern may be reduced, such that the inductance characteristics may be reduced.

The width of the external pattern may be expanded when the external pattern is formed, but the space between the external patterns may not be sufficient to cause the short.

The width of the first coil pattern may be equal to that of the external pattern.

The first coil pattern 41 and the external pattern 46 may be covered with an insulating film 30.

The insulating film 30 may serve to protect the first coil pattern and the external patterns 46.

The insulating film 30 may be formed of any material including an insulating material. For example, as the material of the insulating film 30, an insulating material used for the general insulating coating, for example, an epoxy resin, a polyimide resin, a liquid crystalline polymer resin, or the like may be used or the known photoimageable dielectric (PID) resin or the like may be used but the material of the insulating film 30 is not limited thereto.

The insulating film 30 may be integrated with the insulating layer according to a manufacturing method, but is not limited thereto.

The external electrodes 81 and 82 may be electrically connected to lead terminals of the first and second coil patterns and the third coil pattern, respectively, which are exposed on at least one end face of the body.

If the coil component 100 is mounted in the electronic device, the external electrodes 81 and 82 may serve to electrically connect the coil part within the coil component 10A to the electronic device.

The external electrodes 81 and 82 may be formed using a conductive paste including a conductive metal and the conductive metal may include at least one of copper (Cu), nickel (Ni), tin (Sn), and silver (Ag) or alloys thereof.

The external electrode may include a plating layer formed on the paste layer.

The plating layer may contain one or more selected from the group consisting of nickel (Ni), copper (Cu), and tin (Sn). For example, a nickel (Ni) layer and a tin (Sn) layer may be sequentially formed.

Figure 4:
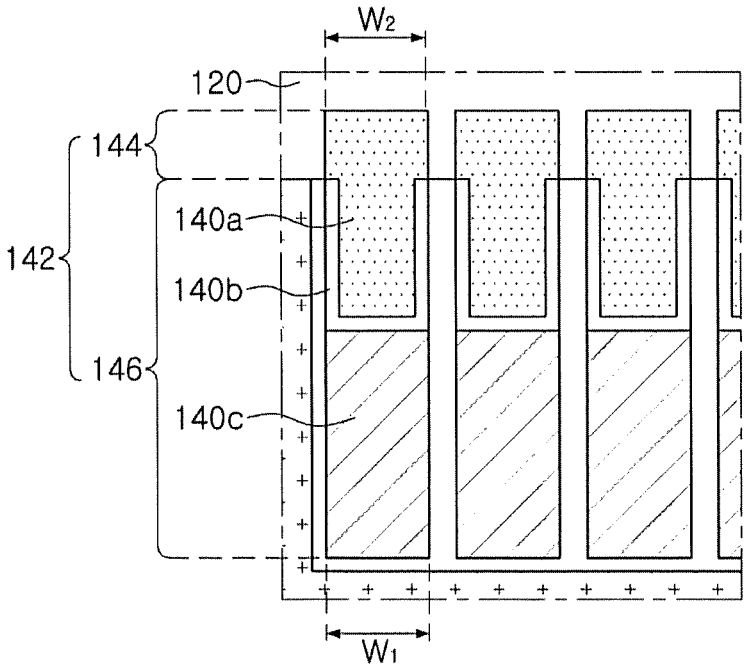

FIG. 4 shows another schematic enlarged view of part A of FIG. 2, according to modified embodiment.

Referring to FIG. 4, the width $W_2$ of the embedded pattern 44 may be equal to the width $W_1$ of the external pattern 146. At this point, a first plating layer 140*a* of the external pattern 146 may have a smaller width than the embedded pattern 120, and after a second plating layer 140*b* of the external pattern 146 is formed, the external pattern 146 and the embedded pattern 144 may have the same width.

Figure 5:
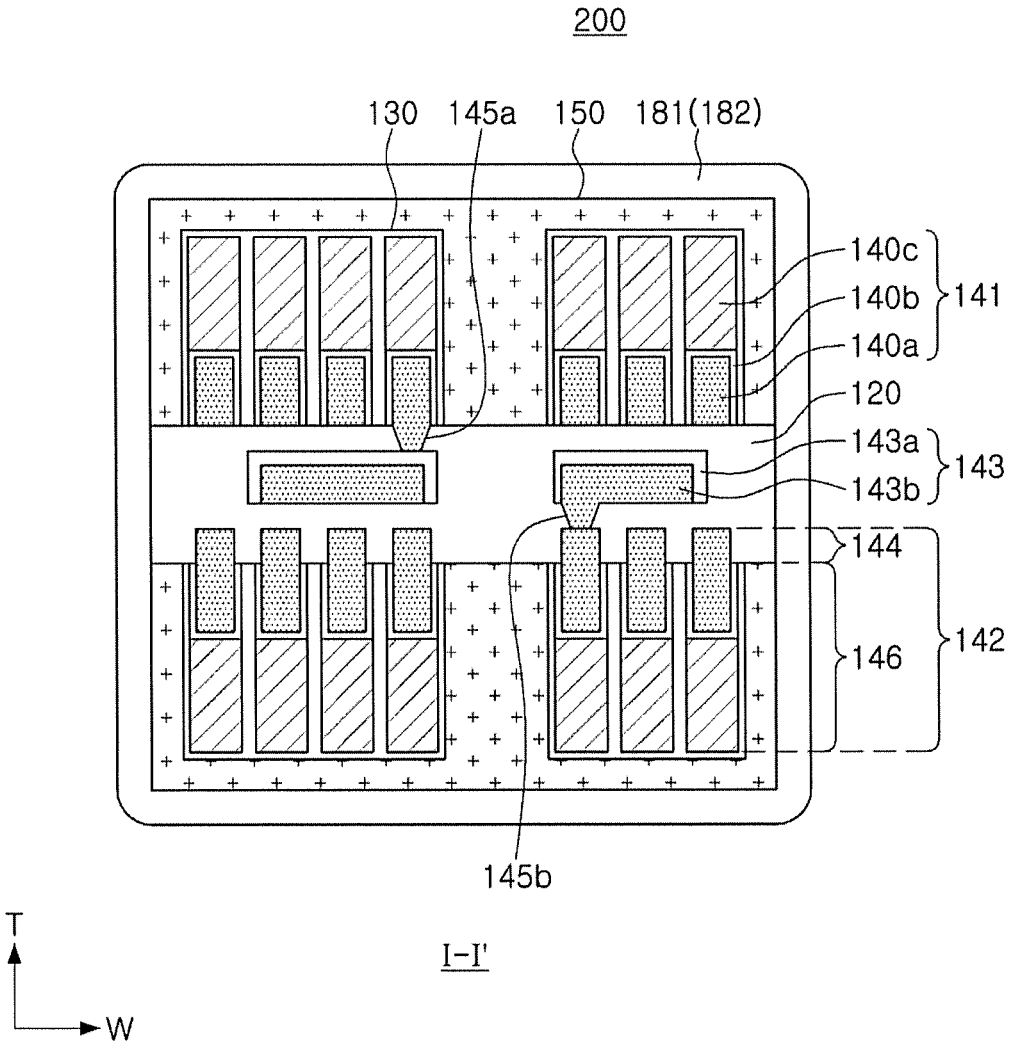
FIG. 5 is a cross-sectional view schematically illustrating a coil component according to another exemplary embodiment in the present disclosure.

FIG. 5 is a cross-sectional view schematically illustrating a coil component according to another exemplary embodiment in the present disclosure.

Referring to FIG. 5, a coil component 200 according to another exemplary embodiment in the present disclosure may include a first coil pattern 141 and a third coil pattern 143 formed inside the insulating layer 120 between the first coil pattern 141 and the embedded pattern 144.

The third coil pattern 143 may be electrically connected to the first coil pattern 141 and the embedded pattern 144, respectively, through vias 145*a* and 145*b* formed inside the insulating layer 20. That is, the third coil pattern 143 may be disposed between the first and second coil patterns 141 and 142 and inside the insulating layer 120.

The third coil pattern 143 may include a first plating layer 143*a* and a second plating layer 143*b* formed to cover the first plating layer. Here, the width of the third coil pattern 143 may be increased by the second plating layer 143*b*.

The third coil pattern 143 may have a single turn, and the first and second coil patterns 141 and 142 may have plural turns. Here, the term "having the single turn" may mean having a turn equal to or less 1 and having the term "having plural turns may mean having a turn greater than 1. The turns of the coil pattern may be adjusted depending on an aspect ratio, and the cross sectional area of the coil component may be reduced while the turns may be increased equally, and therefore it may be useful for realizing the high inductance of the coil component.

If the aspect ratio of the coil pattern of the third coil pattern 143 is less than 1, the height and width of the coil pattern may be freely adjusted within a range permitted by the technique of the coil pattern forming process, and therefore the uniformity of the coil pattern may be excellent and the coil pattern may be wide in the width direction to have the increased cross sectional area, thereby implementing the low direct current (Rdc) characteristics.

A final coil pattern of the first coil pattern 141 and the second coil pattern 142 may have an aspect ratio (AR), a ratio of thickness to width, greater than 1.

To secure the characteristics of the coil component while increasing the thickness of the coil pattern, the first and second coil patterns 141 and 142 may suffer from anisotropic plating after the coil pattern plating to increase the coil thickness. As a result, the thickness of the final coil pattern of the first and second coil patterns 141 and 142 may be greater than the width of the final coil pattern.

Therefore, if the aspect ratio of coil patterns of the first and second coil patterns 141 and 142 is greater than 1, the coil patterns of the first and second coil patterns 141 and 142 may have more turns than the coil pattern of the third coil pattern 143 on the same plane. That is, the cross sectional area of the coil part may be reduced but the turn may be increased as much, and therefore it is particularly useful for realizing high inductance.

Since the third coil pattern 143 has an aspect ratio lower than 1, the thickness may be formed to be thin and since the first and second coil patterns 141 and 142 have an aspect ratio greater than 1, a line width of the coil pattern 143 may be formed to be thin.

A plurality of plating layers may be formed to increase the aspect ratio of the first and second coil patterns. The first coil pattern and the external pattern may include first plating layers 40*a* and 140*a*, second plating layers 2 formed to cover the first plating layer, and third plating layers 40*c* and 140*c* formed on the second plating layer.

Referring to FIGS. 4 and 5, the first plating layers 40*a* and 140*a* may be formed on the embedded pattern 44 and 144, respectively and may have the same width as that of the embedded pattern 44 and 144, and the second plating layers 40*b* and 140*b* may be formed to cover the first plating layers 40*a* and 140*a*, respectively, by isotropic plating and therefore may have the width more than that of the first plating layers 40*a* and 140*a*. The width of the second coil pattern 142 may be equal to that of the external pattern 146.

The third plating layers 40*c* and 140*c* may be formed in the form in which only the thickness is increased on the second plating layers 40*b* and 140*b*, respectively, by the anisotropic plating.

In the case of the external pattern, the first plating layer may be formed on the embedded pattern.

The plurality of coil patterns may be formed to maximally utilize the space in the horizontal direction, that is, the length direction or the width direction to have sufficient turns.

Referring to FIG. 5, the first and second coil patterns 141 and 142 and the third coil pattern 143 may be stacked on the lower and upper portions, respectively, and have the overlapping regions. As a result, the coil component of the present disclosure may be implemented to have sufficient coil characteristics while being thin.

A description of an insulating film 130 and external electrodes 181 and 182 may refer to the description of the insulating film 30 and the external electrodes 81 and 82. To avoid redundancy, an overlapped description will be omitted.

Hereinafter, a method of manufacturing a coil component according to an exemplary embodiment in the present disclosure will be described.

FIGS. 6A through 6D are a schematic process cross-sectional view illustrating a method for manufacturing a coil component according to an exemplary embodiment in the present disclosure.

A description of the same components as those shown in FIGS. 1 through 5 will be omitted.

Referring to FIGS. 6A through 6D, a method for manufacturing a coil component according to an exemplary embodiment in the present disclosure may include forming a body for receiving a coil part, in which the forming of the coil part may include forming the embedded pattern 44 on at least one surface of the support member 70, forming the insulating layer 20 to cover the embedded pattern 44, removing the support member 70 so that the embedded pattern 44 is exposed on the lower surface of the insulating layer 20, and obtaining the first and second coil patterns 41 and 42 by performing the plating process on the upper and lower surface of the insulating layer 20, and the second coil pattern 42 may include the external pattern 46 formed by performing the plating process on the embedded pattern 44 exposed on the lower surface of the insulating layer 20.

Figure 6A:
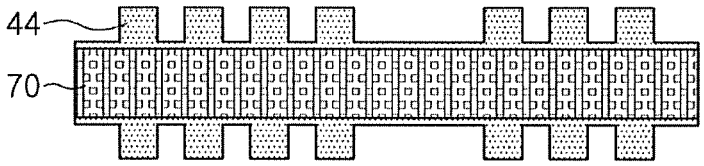
FIGS. 6A through 6D are a schematic process cross-sectional view illustrating a method for manufacturing a coil component according to an exemplary embodiment in the present disclosure.

Referring to FIG. 6A, the embedded pattern 44 may be formed on at least one surface on the support member 70.

The embedded pattern 44 may be formed by forming a seed layer 60 on the support member 70 and then performing the plating process on the pattern formed by the photolithography process.

The support member 70 may be a copper clad laminate (CCL), a polypropylene glycol (PPG) substrate, a ferrite substrate, a metal soft magnetic substrate, or the like. Further, the support member 70 may be an insulating substrate formed of an insulating resin. As the insulating resin, a thermosetting resin such as an epoxy resin, a thermoplastic resin such as polyimide, or a thermosetting or thermoplastic resin in which a reinforcing material such as a glass fiber and an inorganic filler may be impregnated to form a material such as prepreg, ajinomoto build-up film (ABF), FR-4, bismaleimide triazine (BT) resin, a photoimageable dielectric (PID) resin, or the like may be used.

The embedded pattern 44 may be formed by plating metal having excellent electrical conductivity. As the metal, for example, silver (Ag), palladium (Pd), aluminum (Al), nickel (Ni), titanium (Ti), gold (Au), copper (Cu), platinum (Pt), or alloys thereof may be used.

Figure 6B:
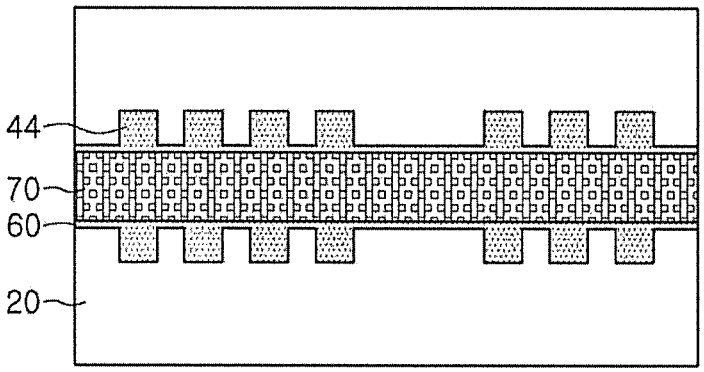

Next, referring to FIG. 6B, the insulating layer 20 may be formed to cover the embedded pattern 44.

The insulating layer 20 may be formed by laminating a precursor film including an insulating material on the support member formed with the first coil pattern and then curing the precursor film.

The insulating layer 20 may be a build-up film containing an insulating material. As the insulating material, for example, a thermosetting resin such as an epoxy resin, a thermoplastic resin such as polyimide, or a thermosetting or thermoplastic resin in which a reinforcing material such as an inorganic filler may be impregnated to form a material such as an ajinomoto build-up film (ABF), or the like may be used. Alternatively, it may be an insulating film including the known photoimageable dielectric (PID) resin.

Figure 6C:
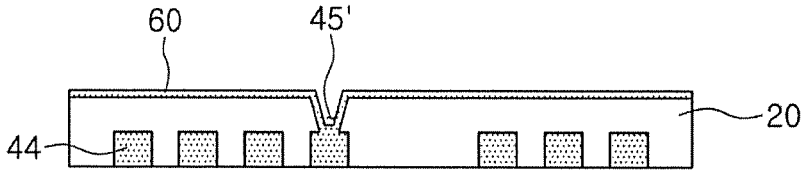

Next, referring to FIG. 6C, the support member 70 may be removed so that the embedded pattern 44 is exposed on the lower surface of the insulating layer 20.

If the support member 70 is removed, a coil laminate in which one side of the embedded pattern 44 is exposed may be obtained.

The warpage of the substrate and the thickness between the coil patterns may be reduced due to the removal of the support member 70, and the size of the via for the interlayer connection may be reduced due to the reduction in the thickness between the coil patterns. Furthermore, the size of the insulating layer and the via may be easily adjusted as needed.

Next, a via 45' connected to the embedded pattern 44 may be formed in the insulating layer 20.

The via 45' may be formed by the photolithographic process and the plating process.

The via 45' may be formed of conductive materials such as copper (Cu), aluminum (Al), silver (Ag), tin (Sn), gold (Au), nickel (Ni), lead (Pb), and alloys thereof.

According to the present disclosure, by forming the via on the coil pattern by using the photolithography process and the plating process, the machining process for forming the through hole in the support member may be omitted, and as a result, manufacturing costs may be reduced.

Thereafter, the seed layer 60 may be formed on the upper surface of the insulating layer.

Figure 6D:
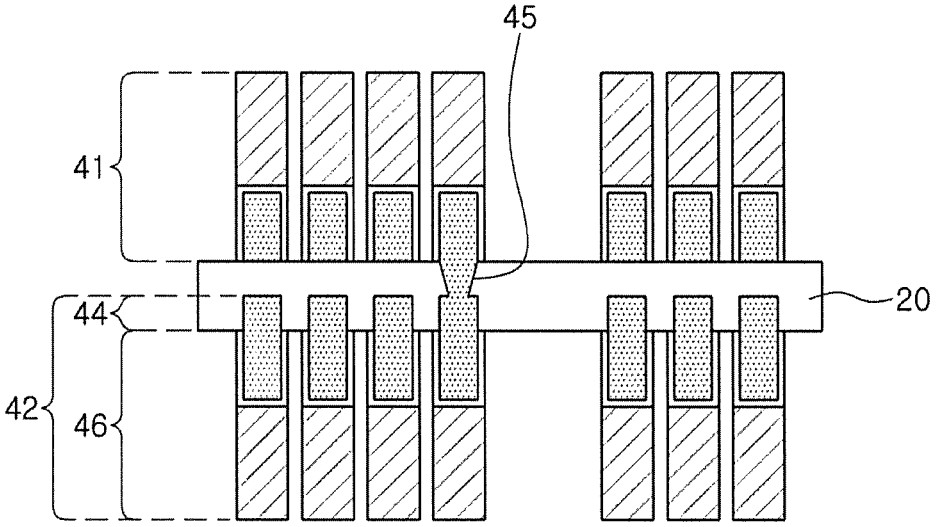

Next, Referring to FIG. 6D, the plating process may be performed on the upper and lower surfaces of the insulating layer to obtain the first and second coil patterns 41 and 42, respectively.

The first plating layer (not shown) may be formed by forming patterns on the embedded pattern 44 exposed on the lower surface of the insulating layer and the upper surface of the insulating layer by the photolithography process, and then performing isotropic plating.

Thereafter, the second plating layer (not shown) may be formed by isotropic plating to cover the first plating layer, thereby increasing the width of the coil pattern. Thereafter, the third plating layer (not shown) may be formed on the second plating layer by anisotropic plating, thereby securing the thickness of the coil pattern.

The second and third plating layers may be formed for the purpose of characteristics implementation as needed.

After the first plating layer is formed, the method for manufacturing a coil component may further include removing the seed layer already formed by etching the seed layer. By the etching process, the width of the first plating layer may be equal to or smaller than that of the embedded pattern.

By the above-mentioned process, the first and second coil patterns 41 and 42 may be simultaneously obtained. The second coil pattern 42 may include the embedded pattern 44 exposed on the lower surface of the insulating layer and the external pattern 46 formed by performing the plating process on the embedded pattern.

Therefore, the thickness of the second coil pattern 42 may be greater than the thickness of the first coil pattern 41 due to the embedded pattern 44.

The process of forming the coil pattern may be repeated once or more before the removing of the support member to form a multilayered coil, and the number of layers may be increased or decreased as needed.

Specifically, the method for manufacturing a coil component may include forming the third coil pattern (not shown) and forming the insulating layer to cover the third coil pattern, prior to the removing of the supporting member.

The third coil pattern may be formed to be disposed inside the insulating layer.

The third coil pattern may be connected to the first coil pattern and the embedded pattern, respectively, through the vias.

In the case of forming the third coil pattern, the coil pattern may be realized as a three-layer structure and thus the coil turns may be increased to improve the inductance.

As set forth above, according to exemplary embodiments of the present disclosure, the coil component may reduce the volume of the insulation material in the body to secure the low direct current resistance (Rdc) characteristics and increase the volume of the magnetic material by the reduced volume of the insulating material to improve the inductance (Ls) characteristics.

While exemplary embodiments have been shown and described above, it will be apparent to those skilled in the art that modifications and variations could be made without departing from the scope of the present invention as defined by the appended claims.

What is claimed is:

1. A coil component, comprising:
a body having a coil part disposed therein,
wherein the coil part includes:
an insulating layer;
a first coil pattern disposed entirely on one surface of the insulating layer;
a second coil pattern including an external pattern disposed on another surface of the insulating layer opposing the one surface; and
a via connected to the first coil pattern, the via extending into the insulating layer from the one surface and spaced apart from the another surface of the insulating layer, and
the second coil pattern further includes an embedded pattern in the insulating layer, and the external pattern is disposed on the embedded pattern.

2. The coil component of claim 1, wherein the thickness from the one surface of the insulating layer to the embedded pattern ranges from 5 μm to 30 μm.

3. The coil component of claim 1, wherein a width of the embedded pattern is smaller than that of the external pattern.

4. The coil component of claim 1, wherein the second coil pattern is thicker than the first coil pattern.

5. The coil component of claim 1, wherein the first coil pattern and the external pattern include a first plating layer, a second plating layer covering the first plating layer, and a third plating layer formed on the second plating layer.

6. The coil component of claim 1, wherein a thickness of the first coil pattern is equal to that of the external pattern.

7. A coil component, comprising:
a body having a coil part disposed therein,
wherein the coil part includes:
an insulating layer;
a first coil pattern disposed entirely on one surface of the insulating layer;
a second coil pattern including an external pattern disposed on another surface of the insulating layer opposing the one surface; and
a third coil pattern disposed inside of the insulating layer and between the first and second coil patterns, upper and lower surfaces of the third coil pattern opposing each other and spaced apart from the one surface and the another surface of the insulating layer, and
the second coil pattern further includes an embedded pattern in the insulating layer, and the external pattern is disposed on the embedded pattern.

8. The coil component of claim 7, wherein the third coil pattern has a single turn.

9. The coil pattern of claim 7, wherein the third coil pattern is connected to the first coil pattern and the embedded pattern, respectively, through vias.

10. A coil component, comprising:
an insulating layer;
a first coil pattern disposed on one surface of the insulating layer;
a second coil pattern including an embedded pattern in the insulating layer and an external pattern disposed on another surface of the insulating layer opposing the one surface; and
a via connected to the first coil pattern, the via extending into the insulating layer from the one surface and spaced apart from the another surface of the insulating layer,
wherein a distance from the first coil pattern to the other surface of the insulating layer is greater than a distance from the second coil pattern to the one surface of the insulating layer.

11. The coil component of claim 10, wherein a thickness of the second coil pattern is greater than that of the first coil pattern.

12. The coil component of claim 11, wherein the thickness of the first coil pattern is equal to that of the external pattern of the second coil pattern.

* * * * *